United States Patent [19]

Benaquista

[11] 4,372,056

[45] Feb. 8, 1983

[54] TREADS

[76] Inventor: Florence Benaquista, 524 Lincoln Ave., Pittsburgh, Pa. 15202

[21] Appl. No.: 222,725

[22] Filed: Jan. 2, 1981

[51] Int. Cl.[3] ..... A43B 3/10; A43B 15/00

[52] U.S. Cl. ..... 36/7.7; 36/7.6

[58] Field of Search ..... 36/7.6, 62, 8.1, 106, 36/7.7

[56] References Cited

U.S. PATENT DOCUMENTS

| | | | |
|---|---|---|---|
| 3,683,519 | 8/1972 | Creamer | 36/8.1 |
| 3,699,672 | 10/1972 | Sims | 36/7.7 |
| 4,251,932 | 2/1981 | Love | 36/7.7 |

*Primary Examiner*—Patrick D. Lawson
*Attorney, Agent, or Firm*—William J. Ruano

[57] ABSTRACT

A safety device, being a pair of half soles designed with a non skid tread to be worn over the shoes of men, women and children to prevent slipping and falling on icy streets. The non skid sole is secured with an elastic instep band with two elastic support bands being secured to instep band and non skid sole on either side and in parallel relation. The flexibility of the elastic bands allows for easy convenient slip on over the shoe, adjusting to accommodate any shoe width and folding compactly for convenience in carrying when not in use.

1 Claim, 4 Drawing Figures

TREADS

BACKGROUND OF INVENTION

My invention, for a compact convenient to carry throughout the winter, non skid safety sole was born of necessity.

Many times throughout the years, I have left work only to find myself in the precarious position of having to navigate along an icey sidewalk with absolutely no protection against falling. In addition to my own dilemma, I have observed others, both men and women inching their way along to either bus stop or parking lot.

I have concluded that there is just one reason why we are caught unprepared when the unexpected icey condition presents itself, that reason being inconvenience. It is too inconvenient to carry large cumbersome boots each day just on the chance they may be needed. But something that would fold compactly, that we could carry with us all winter in either handbag, briefcase or coat pocket, something that would slip over the shoe as easily as a garter to provide the immediate protection we needed would certainly be the answer.

Therefore, I have decided to invent such a device myself.

SUMMARY OF INVENTION

It is therefore an important object of this invention to provide a non skid treaded sole with attached elastic bands to slip over shoes when an unexpected icey condition occurs.

It is also an important object of this invention to provide a non skid easy to slip on sole with flexible elastic bands adjusting to accommodate all shoe widths.

It is further an important object of this invention to provide a non skid easy to slip on sole that folds to a slim concise package for convenience in carrying throughout the winter, always being handy for unexpected ice laden streets.

Heavy boots and slip on rubbers have been on the market a long time and while they certainly perform a junction are both too bulky and awkward to carry with us at all times during the winter. However with Treads, the flexibility of the elastic bands will permit tight, close folding resulting in a thin almost flat packet that can be very conveniently carried.

Because of the fact that Treads are extremely convenient to carry even in the coat pocket, it is important to remember that whether being carried by the office worker going to work or the little old lady going to the bingo, it is this very convenience factor that will save lives.

Both the simplicity and economy in its construction plus the safety and convenience provided by its use are all features that enhance the desirability of Treads.

And now, referring to the accompanying drawings.

REFERENCE TO DRAWINGS

BROADENING STATEMENT OF DRAWINGS

Figure 1:
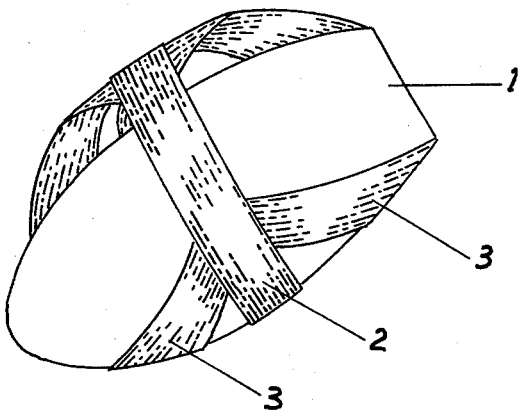
FIG. 1 is the perspective view of my invention

In describing the preferred embodiment of the invention illustrated in the drawings, specific terminology will be used for the sake of clarity. However, it is not intended to be limited to the specific terms so selected and it is to be understood that each specific term includes all technical equivalents which will operate in a similar manner to accomplish a similar purpose.

DETAILED DESCRIPTION OF THE PREFERRED EMBODIMENT

My invention, a convenient to carry pair of non skid half soles constructed with a tread and attached elastic bands for easy slip on, are designed to be worn over shoes when icey sidewalks make walking hazardous. Non skid soles to be constructed preferably of rubber or soft plastic that will accommodate a tread and with bands to be constructed of elastic for ease in slipping over shoes and affording greater flexibility in accommodating various shoe widths.

Referring now more specifically to each of the drawings and particularly to the perspective view FIG. 1, the construction of which consists of a flat, non skid half sole constructed with a tread (1) to which is attached on either side and in parallel relation an elastic instep band (2) and with said instep band to have on either side an attachment of two elastic end support bands (3) being spaced apart a distance substantially equal to length of non skid sole at the point of attachment to the sole.

Figure 2:
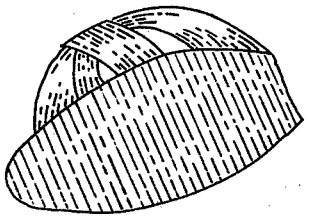
FIG. 2 is the bottom view of the sole of my invention

The bottom of the treaded sole is shown in FIG. 2.

Figure 3:
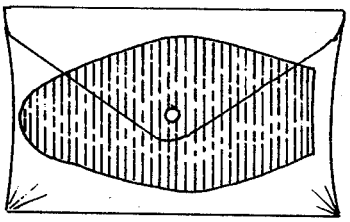
FIG. 3 is view showing Treads folded compactly in pouch.

The pair of Treads is folded together compactly with the elastic bands golded between the two soles, creating an almost flat, concise parcel to conveniently carry in the pouch FIG. 3.

Figure 4:
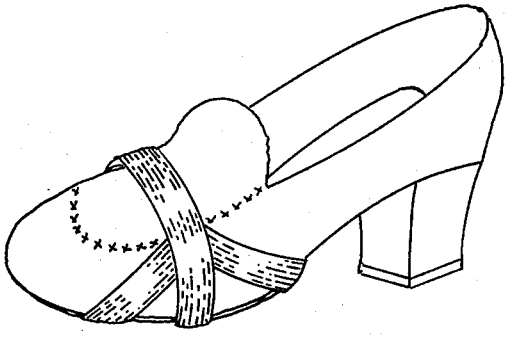
FIG. 4 is view showing Treads as they fit over the shoe.

Treads as they look while being worn FIG. 4, with instep band and end support bands adjusting to accommodate shoe width.

It has been seen from the foregoing description that all of the objects previously set forth have been accomplished. It is now possible to have:

1. A pair of non skid, treaded soles to wear over shoes to prevent slipping and falling on icey sidewalks.
2. A pair of non skid treaded soles that are constructed with elastic bands for easy slip on and with elastic bands affording flexibility, adjusting to shoe width.
3. A pair of non skid treaded soles that fold together compactly in a convenient to carry pouch, making a non cumbersome packet that can be carried all through the winter, always handy when the emergency arises.

While in the foregoing, there has been provided a detailed description of a particular embodiment of the present invention, it is to be understood that all equivalents obvious to those having skill in the art are to be included within the scope of the invention as claimed.

I claim:

1. A pair of non-skid half soles having a non-skid outer tread design to prevent slipping and falling on icy streets, elastic strap means inter-connecting extended side portions of each of said half soles, said elastic strap means comprises a single strap for each half sole and a pair of angularly extending straps on each side of the half sole connected to the front and rear portions of said half sole, said flexible strap means being foldable to enable carrying of said half soles in a compact package.

* * * * *